US007299797B2

(12) United States Patent
Huang

(10) Patent No.: US 7,299,797 B2
(45) Date of Patent: Nov. 27, 2007

(54) SPRINGLESS SHOOTING DART

(76) Inventor: Chien Kai Huang, 730 Potter Bar Ln, Suwanee, GA (US) 30024

( * ) Notice: Subject to any disclaimer, the term of this patent is extended or adjusted under 35 U.S.C. 154(b) by 503 days.

(21) Appl. No.: 11/024,256

(22) Filed: Dec. 29, 2004

(65) Prior Publication Data

US 2006/0137673 A1 Jun. 29, 2006

(51) Int. Cl.
*F41B 3/00* (2006.01)

(52) U.S. Cl. ..... 124/79

(58) Field of Classification Search ..... 124/35.1, 124/79; 221/279; 222/386
See application file for complete search history.

(56) References Cited

U.S. PATENT DOCUMENTS 2,643,662 A * 6/1953 Bunce ..... 134/164
3,333,360 A * 8/1967 Odessa ..... 446/369
5,370,571 A * 12/1994 Bosch ..... 446/429
5,433,641 A * 7/1995 Rudell et al. ..... 446/28
5,512,003 A * 4/1996 Parker ..... 446/475

* cited by examiner

*Primary Examiner*—John A. Ricci
(74) *Attorney, Agent, or Firm*—Troxell Law Office, PLLC

(57) ABSTRACT

A springless shooting dart composed of a hollow cylinder, a shuttle, a rope, and a dart is provided. Inside the hollow cylinder is a shuttle. A dart can be disposed at the front end of the shuttle. The shuttle is connected to a rope having one end tied to the user's waist. A user can control the dart to be shot out by holding on to the cylinder and extending from his arm.

2 Claims, 4 Drawing Sheets

SPRINGLESS SHOOTING DART

FIELD OF THE INVENTION

The Chinese martial arts have a history of thousands of years. Practicing martial arts can not only protect oneself, but also be an exercise to make oneself healthier. Since there exist many advantages without drawbacks, many Chinese ancestors have been practicing martial arts, the most famous one being the Show-Lin style, or Kung-Fu. Besides the general punching and kicking, the Chinese martial arts utilize weaponry to assist, with the most well known Chinese individual weaponry being the shooting dart.

The original method of using the above-mentioned portable dart is to hold it with one hand, and then shoot out using the force of one's arm and wrist. In recent years, a device having a spring-assisted element inside has been developed; the dart is shot out by the tension of the spring. However, the traditional dart operable by one's hand and arm is hard to operate without special training, and the operation is very tiring. The other spring-assisted darting device has a complex structure and a complicated operating procedure, and thus is not useful equipment for self-defense, exercise, or entertainment.

Because of the above-said drawbacks of the conventional dart and the assistance thereof, the inventor has invented a springless shooting dart without these drawbacks. The method for using this invention is to control the springless shooting dart by arm-extension so as to shoot out the dart with high speed and accuracy. The present invention utilizes a hollow cylinder having a shuttle inside; a dart can be placed at the front end of the shuttle. The shuttle is connected by rope. One end of the rope is tied to the user's waist. By holding the cylinder and pushing it outwards, the shuttle moves forwards and pushes the dart in the front to be shot out instantly.

SUMMARY OF THE INVENTION

The present invention is a springless shooting dart that is controlled by arm-extension so as to shoot out the dart with high speed and accuracy. The present invention utilizes a hollow cylinder having a shuttle disposed inside; a dart can be placed at the front end of the shuttle. The shuttle is connected by rope. One end of the rope is tied to the user's waist. By holding the cylinder and pushing it outwards, the shuttle moves forwards and pushes the dart in the front to be shot out instantly.

DETAILED DESCRIPTION OF THE EMBODIMENT

Figure 1:
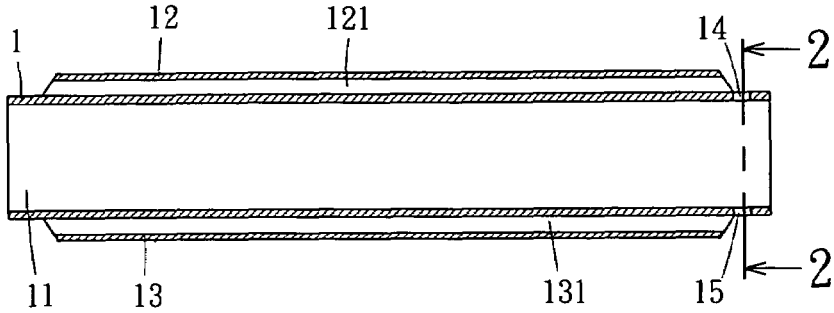
FIG. 1 is a cross-sectional view of the hollow cylinder of the present invention.
Figure 2:
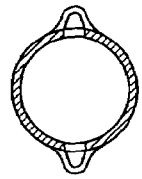
FIG. 2 is a cross-sectional view of the cross section of the hollow cylinder of the present invention.
Figure 3:
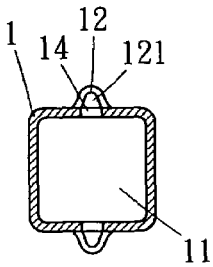
FIG. 3 is a cross-sectional view of the cross section of another hollow cylinder of the present invention.
Figure 4:
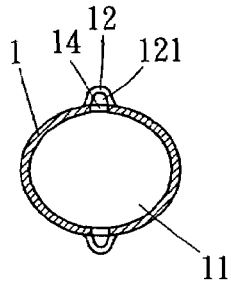
FIG. 4 is a cross-sectional view of the cross section of another hollow cylinder of the present invention.
Figure 5:
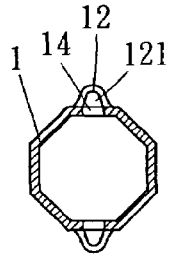
FIG. 5 is a cross-sectional view of the cross section of another hollow cylinder of the present invention.

Refer to FIGS. 1 and 2, the springless shooting dart of the present invention includes a hollow cylinder 1, a shuttle 2, a rope 3, and a dart 4. The shape of the hollow cylinder 1 is not limited to cylindrical, but can be rectangular, elliptical and polyhedral, as shown in FIGS. 3, 4, and 5.

The hollow cylinder 1 mentioned above has a hollow portion 11 inside; the outer rim has a flange 12, 13 correspondingly; the flanges 12, 13 each have a respective tunnel 121, 131 inside; and the front end of the hollow cylinder 1 has connecting holes 14, 15 set close to the tunnels 121, 131.

Figure 6:
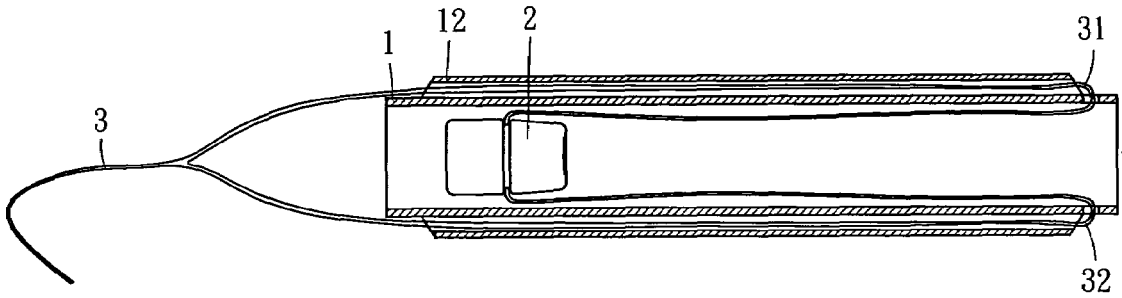
FIG. 6 is a longitudinal view of the shuttle disposed in the hollow cylinder of the present invention.

As shown in FIG. 6, a shuttle 2 is disposed inside the hollow portion 11 of the above-mentioned hollow cylinder 1; the shuttle 2 is connected to one end of the two separate sub ropes 31, 32, while the other end of the sub ropes 31, 32 is led through the tunnels 121, 131 in the flange 12, 13 via the connecting holes 14, 15, and comes out of the end of tunnels 121, 131 of the hollow cylinder 1. Then sub ropes 31, 32 are merged into a main rope 3.

Figure 7:
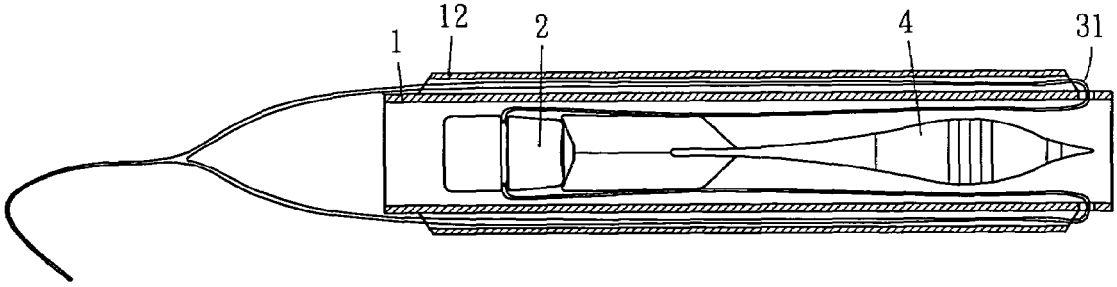
FIG. 7 is a longitudinal view of the shuttle and the dart disposed in the hollow cylinder of the present invention.

As shown in FIG. 7, a dart 4 is disposed at the front end of the shuttle 2 inside the hollow portion 11 of the hollow cylinder 1, and the end of the dart 4 is connected to the front end of the shuttle 2.

Figure 8:
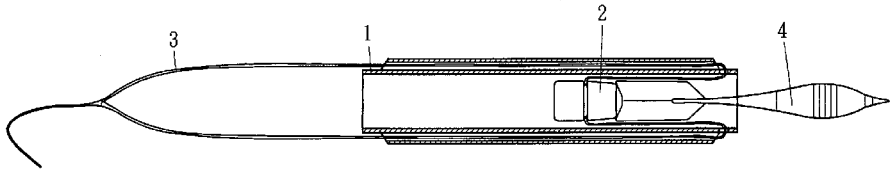
FIG. 8 is a diagram showing the springless shooting dart of the present invention being shot.
Figure 9:
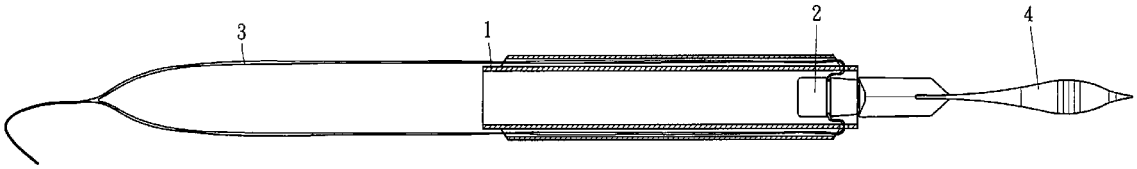
FIG. 9 is a diagram showing the springless shooting dart of the present invention being shot.
Figure 10:
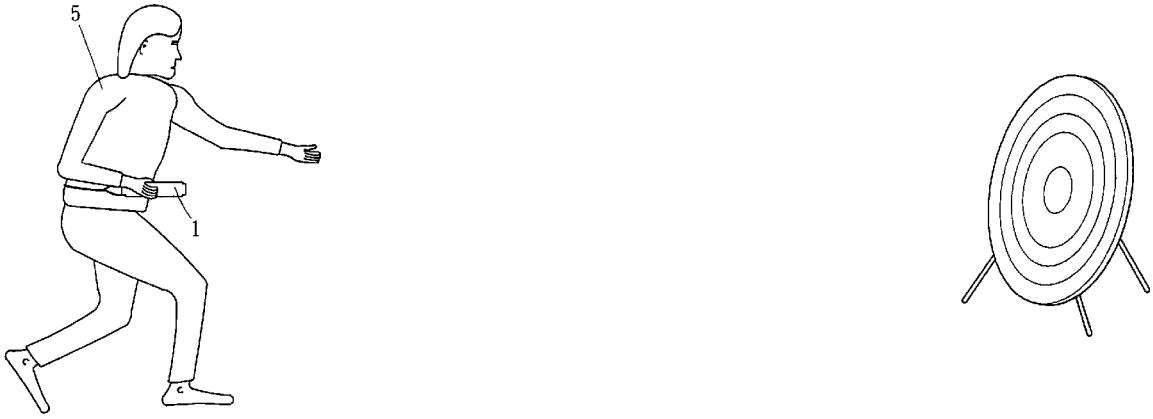
FIG. 10 is a diagram showing the springless shooting dart of the present invention being shot.
Figure 11:
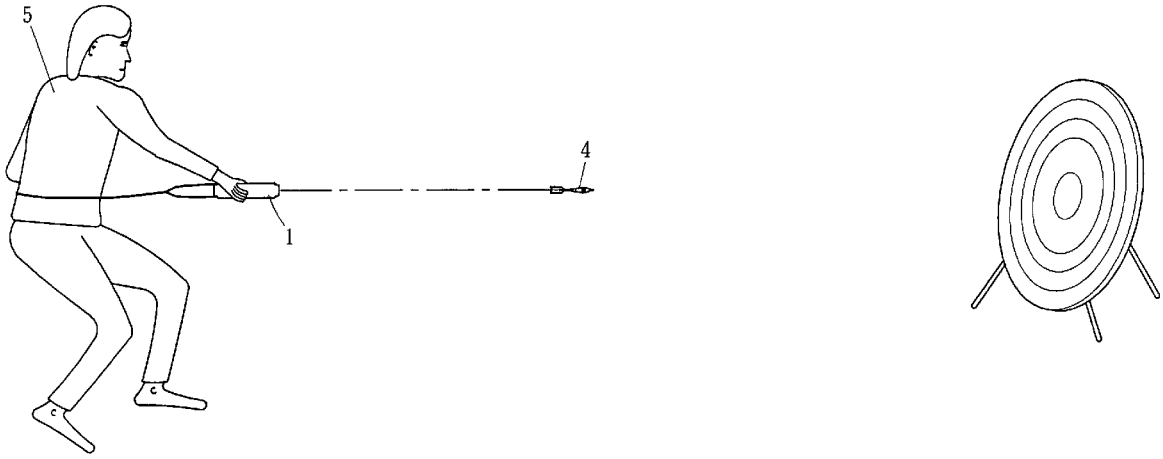
FIG. 11 is a diagram showing the springless shooting dart of the present invention being shot.

As shown in FIGS. 8, 9, and 10, when the present invention is implemented, the other end of the main rope 3 can be tied to the user's 5 waist, and the user 5 holds the hollow cylinder in his hand. When the user's arm is extended, the main rope 3 and the sub ropes 31, 32 are pulled backwards, allowing the shuttle 2 in the back end of the hollow portion 11 of the hollow cylinder 1 to be pushed forward instantly. Subsequently, the dart 4 is shot out from the opening, as shown in FIG. 11 where the principle in movement is the same as is shown in FIGS. 8 and 9.

What is claimed is:

1. A springless shooting dart, comprising a hollow cylinder, a shuttle, a rope and a dart; wherein said hollow cylinder is hollow inside; the outer rim of said hollow cylinder has a flange correspondingly; said flange has a tunnel inside; the front end of said hollow cylinder has a connecting hole set close to the tunnel; a shuttle is disposed inside said hollow cylinder; said shuttle is connected to one end of two separate sub ropes; the other end of said sub ropes is led through the tunnel in said flange via said connecting hole, and comes out of the end of the hollow cylinder, and then said sub ropes are merged into a main rope; a dart is disposed at the front end of the above said shuttle, and when implemented, the present invention can be tied on to a user's waist with the other end of the main rope, and the user can hold said hollow cylinder by hand; by extending the user's arm and subsequently pulling the main and sub ropes, the shuttle inside the back of the hollow cylinder is pushed forward instantly so as to be shot out from the opening.

2. The springless shooting dart of claim 1, wherein said hollow cylinder is not limited to cylindrical shape, but can be rectangular, elliptical or polyhedral.

* * * * *